US010524066B2

(12) United States Patent
Vendelbo

(10) Patent No.: US 10,524,066 B2
(45) Date of Patent: Dec. 31, 2019

(54) FITTING DEVICES, SERVER DEVICES AND METHODS OF REMOTE CONFIGURATION OF A HEARING DEVICE

(71) Applicant: GN HEARING A/S, Ballerup (DK)

(72) Inventor: Allan Munk Vendelbo, Ballerup (DK)

(73) Assignee: GN HEARING A/S, Ballerup (DK)

( * ) Notice: Subject to any disclaimer, the term of this patent is extended or adjusted under 35 U.S.C. 154(b) by 59 days.

(21) Appl. No.: 15/813,140

(22) Filed: Nov. 14, 2017

(65) Prior Publication Data

US 2018/0167751 A1 Jun. 14, 2018

(30) Foreign Application Priority Data

Dec. 8, 2016 (EP) ..... 16202916

(51) Int. Cl.
*H04R 25/00* (2006.01)

(52) U.S. Cl.
CPC ..... *H04R 25/558* (2013.01); *H04R 25/505* (2013.01); *H04R 25/554* (2013.01); *H04R 25/70* (2013.01); *H04R 25/55* (2013.01); *H04R 2225/55* (2013.01)

(58) Field of Classification Search
USPC ..... 381/312, 314, 315
See application file for complete search history.

(56) References Cited

U.S. PATENT DOCUMENTS

2009/0185703 A1* 7/2009 Aida ..... H04R 25/70 381/314
2010/0205447 A1* 8/2010 Waldmann ..... H04R 25/70 713/182
2011/0200214 A1* 8/2011 Knox ..... H04R 25/50 381/314
2011/0257994 A1 10/2011 Givens
2012/0183164 A1 7/2012 Foo
2013/0047264 A1* 2/2013 Bjorkengren ..... G06F 21/00 726/27
2014/0211972 A1 7/2014 Kim
2015/0289062 A1* 10/2015 Ungstrup ..... H04R 25/554 381/314
2016/0173278 A1 6/2016 Pedersen
2016/0212552 A1* 7/2016 Schneider ..... H04R 25/558
(Continued)

OTHER PUBLICATIONS

Extended European Search Report dated Jun. 8, 2017 for corresponding European Application No. 16202916.9.

*Primary Examiner* — Quoc D Tran
(74) *Attorney, Agent, or Firm* — Vista IP Law Group, LLP

(57) ABSTRACT

A method performed by a fitting device, the fitting device being a part of a hearing system configured for remotely configuring a hearing device, the method includes: obtaining hearing device data comprising a hearing device identifier of the hearing device; obtaining a session key; generating a configuration initiation request based on the session key and the hearing device identifier; transmitting the configuration initiation request to a server device; receiving a configuration initiation response from the server device, the configuration initiation response comprising configuration keying material; generating a configuration package based on configuration data for the hearing device and based on the configuration keying material, the configuration package comprising configuration package data; and transmitting the configuration package to the server device.

16 Claims, 8 Drawing Sheets

(56) References Cited

U.S. PATENT DOCUMENTS

| | | | | |
|---|---|---|---|---|
| 2017/0318400 | A1* | 11/2017 | Westermann | H04R 25/554 |
| 2017/0318457 | A1* | 11/2017 | Westermann | G06F 19/3418 |
| 2018/0310104 | A1* | 10/2018 | Westergaard | H04R 25/70 |

* cited by examiner

FITTING DEVICES, SERVER DEVICES AND METHODS OF REMOTE CONFIGURATION OF A HEARING DEVICE

RELATED APPLICATION DATA

This application claims priority to, and the benefit of, European Patent Application No. 16202916.9, filed on Dec. 8, 2016, pending. The entire disclosure of the above application is expressly incorporated by reference herein.

FIELD

The present disclosure relates to a hearing system comprising a server device, a hearing device, a fitting device and an accessory device. In particular, the present disclosure relates to methods for securing remote configuration of the hearing device by the fitting device, related fitting devices and related server devices.

BACKGROUND

Wireless communication to and from different entities of a hearing system has been increasing in continuation of the developments within wireless communication technology. However, the new technologies entail new challenges for the hearing aid manufacturers in order to secure communication in a hearing system. Wireless communication interfaces of a hearing system desirably use an open standard-based interface. However, this poses many challenges in terms of security. Further, a hearing device is a very small device with strict constraints in terms of computational power, memory space etc.

SUMMARY

There is a need for fitting devices, server devices and methods for providing improved and effective security supporting a remote configuration of the hearing device, such as a remote fitting or a remote fine tuning of the hearing device. Further, there is a need for devices and methods reducing the risk of configuration data being compromised by a third (unauthorized) party.

Accordingly, a method, performed at a fitting device of a hearing system, for remotely configuring a hearing device in the hearing system is provided. The hearing system comprises the hearing device, the fitting device and a server device. The method comprises obtaining hearing device data comprising a hearing device identifier of the hearing device; and obtaining a session key. The method comprises generating a configuration initiation request based on the session key and the hearing device identifier. The method comprises transmitting the configuration initiation request to the server device; and receiving a configuration initiation response from the server device. The configuration initiation response comprises configuration keying material. The method comprises generating a configuration package based on configuration data for the hearing device and based on the configuration keying material, the configuration package comprising configuration package data; and transmitting the configuration package to the server device.

The disclosure also relates to a method, performed at a server device of a hearing system, for remote configuration of a hearing device in the hearing system. The hearing system comprises the hearing device, a user application installed on an accessory device, a fitting device and the server device. The method comprises receiving a configuration initiation request from the fitting device, the configuration initiation request comprising a hearing device identifier, and a session key; and generating configuration keying material based on the session key. The method comprises generating configuration authentication material; and transmitting a configuration initiation response to the fitting device, the configuration initiation response comprising the configuration keying material. The method comprises receiving a configuration package from the fitting device, the configuration package comprising a configuration payload block and a control block. The method may comprise calculating an integrity indicator set based on the configuration payload block and the control block. The method may comprise generating a configuration block based on at least a part of the integrity indicator set. The method comprises generating a configuration verification package based on the configuration block; and generating a configuration authentication package based on the configuration authentication material. The method may comprise transmitting the configuration package, the configuration verification package and the configuration authentication package.

This disclosure relates to a fitting device comprising a processing unit, a memory unit, and an interface. The fitting device is configured to perform any of the steps of the method according to this disclosure.

This disclosure relates to a server device comprising a processing unit, a memory unit, and an interface. The server device is configured to perform any of the steps of the method according to this disclosure.

It is an important advantage of the present disclosure that secure remote configuration of the hearing device is provided while at the same time considering the limited computational power of a hearing device. Thus, effective and secure remote configuration of the hearing device is provided.

A method performed by a fitting device, the fitting device being a part of a hearing system configured for remotely configuring a hearing device, the method includes: obtaining hearing device data comprising a hearing device identifier of the hearing device; obtaining a session key; generating a configuration initiation request based on the session key and the hearing device identifier; transmitting the configuration initiation request to a server device; receiving a configuration initiation response from the server device, the configuration initiation response comprising configuration keying material; generating a configuration package based on configuration data for the hearing device and based on the configuration keying material, the configuration package comprising configuration package data; and transmitting the configuration package to the server device.

Optionally, the act of generating the configuration initiation request comprises encrypting the session key using a configuration initiation public key, and including the encrypted session key in the configuration initiation request.

Optionally, the hearing device data comprises a shared index, a fitting device key identifier, an address identifier, fitting information, or any combination of the foregoing.

Optionally, the configuration keying material is encrypted, and wherein the method further comprises decrypting the configuration keying material.

Optionally, the act of generating the configuration package comprises calculating a configuration data integrity indicator based on the configuration data, and wherein the configuration package data is based on the configuration data integrity indicator.

Optionally, the act of generating the configuration package comprises encrypting the configuration data and/or the configuration data integrity indicator using the configuration keying material, and wherein the configuration package data is based on the encrypted configuration data and/or the encrypted configuration data integrity indicator.

Optionally, the configuration package data comprises a configuration payload block and a control block, and wherein the configuration payload block comprises the encrypted configuration data and the encrypted configuration data integrity indicator.

Optionally, the act of generating the configuration package comprises encrypting the configuration package data.

Optionally, the method further includes: sending an access request to the server device; and receiving an access response from the server device.

Optionally, the method further includes deleting the session key and the configuration keying material after the configuration package is transmitted.

A fitting device includes a processing unit configured to perform any of the above methods.

A method, performed by a server device, the server device being a part of a hearing system configured for remotely configuring a hearing device, the method includes: receiving a configuration initiation request from a fitting device, the configuration initiation request comprising a hearing device identifier, and a session key; generating configuration keying material based on the session key; generating configuration authentication material; transmitting a configuration initiation response to the fitting device, the configuration initiation response comprising the configuration keying material; receiving a configuration package from the fitting device, the configuration package comprising a configuration payload block and a control block; calculating an integrity indicator set based on the configuration payload block and the control block; generating a configuration block based on at least a part of the integrity indicator set; generating a configuration verification package based on the configuration block; generating a configuration authentication package based on the configuration authentication material; and transmitting the configuration package, the configuration verification package, and the configuration authentication package.

Optionally, the act of generating the configuration keying material based on the session key comprises encrypting a configuration session key using the session key, and including the encrypted configuration session key into the configuration keying material.

Optionally, the method further includes: receiving an access request at the server device, the access request comprising a dispenser identifier; and sending an access response to the fitting device.

Optionally, the method further includes: obtaining a first digital signature associated with the configuration block; wherein the configuration verification package is generated based on the first digital signature.

Optionally, the method further includes: obtaining a second digital signature associated with the configuration authentication material; wherein the configuration authentication package is generated based on the second signature.

Optionally, the act of generating the configuration authentication material comprises: obtaining a certificate key based on the hearing device identifier; obtaining a dispenser certificate using the dispenser identifier; encrypting the dispenser certificate using the certificate key; and including the encrypted dispenser certificate in the configuration authentication material.

Optionally, the configuration package comprises encrypted configuration package data, and wherein the method further comprises decrypting the encrypted configuration package data using the session key.

A server device includes a processing unit configured to perform any of the above methods.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
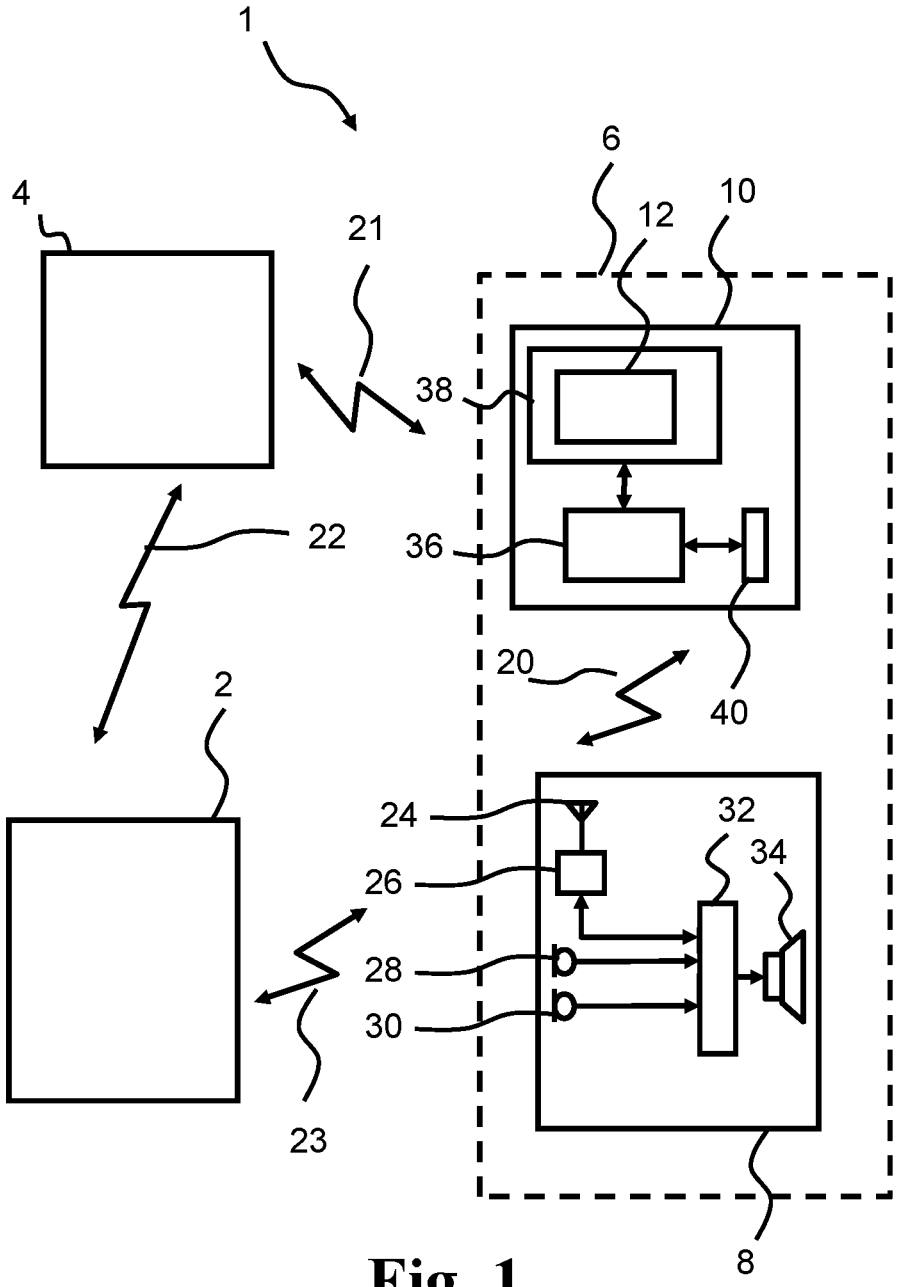
FIG. 1 schematically illustrates a hearing system.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The present disclosure relates to an improved security in remotely configuring a hearing device in a hearing system. The hearing system comprises a server device, a hearing device and a fitting device. The fitting device is controlled by a dispenser. The server device may be controlled by the hearing device manufacturer. The server device may be a distributed server device, i.e. a server device with distributed processors. Namely, the methods, fitting devices and server devices disclosed herein enable a remote configuration of the hearing device by the fitting, where the remote configuration is robust against security threats, vulnerabilities and attacks by implementing appropriate safeguards and countermeasures, such as security mechanisms, to protect against threats and attacks. The present disclosure relates to a method for remote configuration of a hearing device, which is robust against replay attacks, unauthorized access, battery exhaustion attacks, and man-in-the-middle attacks.

The present disclosure addresses a problem that is encountered by dispensers and hearing device users. This can be illustrated in the following example. A hearing device user calls a dispenser (e.g. from home) and complains about the configuration or fitting done earlier at the professional dispenser's office. The dispenser should be able to adjust certain configuration values (e.g. +3 db gain at 1 kHz) in the office and send the resulting configuration package—or fine tuning package—to the hearing device or an accessory having an application installed thereon to handle the hearing device. The hearing device user is able to use the application to download the configuration package and apply it to the hearing device. However, such a retrieval of the configuration package shall be secured, the configuration package shall be integrity protected, and the entire chain of processing leading to the installation of the configuration package on the hearing device shall be confidential, authenticated and integrity protected.

The fitting device comprises a memory unit and an interface respectively connected to a processing unit. The memory unit may include removable and non-removable data storage units including, but not limited to, Read Only Memory (ROM), Random Access Memory (RAM), etc. The fitting device is configured to control and/or configure the hearing device. The interface comprises an antenna and a wireless transceiver, e.g. configured for wireless communication at frequencies in the range from 2.4 to 2.5 GHz. The interface may be configured for communication, such as wireless communication, with the hearing device comprising an antenna and a wireless transceiver, and with the server device.

The present disclosure relates to hearing system communication between entities of a hearing system. The accessory device forms an accessory device to the hearing device. The accessory device is typically paired or otherwise wirelessly coupled to the hearing device. The hearing device may be a hearing aid, e.g. of the behind-the-ear (BTE) type, in-the-ear (ITE) type, in-the-canal (ITC) type, receiver-in-canal (RIC) type or receiver-in-the-ear (RITE) type. Typically, the hearing device system is in possession of and controlled by the hearing device user. The accessory device may be a smartphone, a smartwatch, or a tablet computer.

As used herein the term "identifier" refers to a piece of data that is used for identifying, such as for categorizing, and/or uniquely identifying. The identifier may be in a form of a word, a number, a letter, a symbol, a list, an array or any combination thereof. For example, the identifier as a number may be in the form of an integer, such as unsigned integer, unit, with a length, or more, such as an array of unsigned integers. An identifier may have a length of several bytes. For example, a hearing device identifier may have a length of 10-30 bytes, such as 20 bytes.

The present disclosure relates to a method performed at a fitting device of a hearing system. The method for remotely configuring a hearing device in the hearing system, the hearing system comprising the hearing device, the fitting device, and a server device is provided. The method comprises obtaining hearing device data. The hearing device data comprises a hearing device identifier of the hearing device to be remotely configured by the fitting device. In one or more exemplary methods, obtaining hearing device data comprises obtaining or retrieving the hearing device data from a database remote from the fitting device. The hearing device data comprises a hearing device identifier of the hearing device. The hearing device identifier may refer to a unique device identifier. The hearing device identifier may comprise a hardware number, a serial number, a MAC address. In one or more exemplary methods, the hearing device data may comprise a shared index, a fitting device key identifier, an address identifier (such as a Bluetooth address), and/or fitting information. A shared index may support in identifying a common secret shared with a hearing device, thereby provides an optimization of use of payload. An address identifier may have a length of 2-10 bytes, such as 5 bytes, such as 6 bytes. A shared index may have a length of 1 byte. A fitting device key identifier may have a length between 1 and 3 bytes, such as 2 bytes.

One or more exemplary methods comprises obtaining a session key. Obtaining a session key may comprise generating a session key e.g. as a random or pseudo-random number. The session key may be uniquely generated for each session. The session key may be a symmetric key. A symmetric session key may provide a lightweight processing of the security algorithms on the processing unit, such as lightweight encryption, lightweight decryption, lightweight integrity protection, etc. The session key may have a length between 10 bytes and 20 bytes, such as between 15 and 20 bytes, such as 16 bytes.

One or more exemplary methods comprises obtaining a session counter. Obtaining a session counter may comprise generating a session counter e.g. as a random or pseudo-random number. The session counter may have a length between 10 bytes and 20 bytes, such as between 15 and 20 bytes, such as 16 bytes.

One or more exemplary methods comprises generating a configuration initiation request based on the session key and the hearing device identifier. For example, generating the configuration initiation request may comprise encrypting the session key using a configuration initiation public key, and including the encrypted session key in the configuration initiation request. In one or more exemplary methods, generating the configuration initiation request may comprise encrypting the session key and the session counter by e.g. encrypting the session key, the session counter and a part of the hearing device data (e.g. a shared index, a fitting device key identifier) using the configuration initiation public key. The encryption may be based on RSA crypto-system or any other encryption system.

One or more exemplary methods comprises transmitting the configuration initiation request to the server device. The configuration initiation request may comprise the session key, the hearing device identifier, and optionally part of the hearing device data (e.g. the shared index), and optionally the session counter. The configuration initiation request may be encrypted using the configuration initiation public key prior to transmission.

One or more exemplary methods comprises receiving a configuration initiation response from the server device, the configuration initiation response comprising configuration keying material. In one or more exemplary methods, receiving the configuration initiation response comprises decrypting the configuration keying material. For example, the configuration keying material may be decrypted using the session key. The configuration keying material may comprise a configuration key (such as a symmetric), and possibly a configuration keying counter.

One or more exemplary methods comprises generating a configuration package based on configuration data for the hearing device and based on the configuration keying material. The configuration package may comprise configuration package data. The configuration data may comprise data related to the hearing device. The data related to the hearing device may comprise hearing device settings and/or fitting parameters.

In one or more exemplary methods, generating the configuration package comprises calculating a configuration data integrity indicator based on the configuration data. The configuration package data may be based on the configuration data integrity indicator. The configuration package data may comprise the configuration data integrity indicator. The configuration data integrity indicator, CDI, may refer to an indicator that enable a recipient to verify the integrity of the data to which the CDI is appended. The CDI may comprise for example a hashed checksum, such as checksum based on a hash function, such as SHA function, e.g. SHA1, SHA2. For example calculating a configuration data integrity indicator based on the configuration data may be performed using a hash function.

In one or more exemplary methods, generating the configuration package comprises encrypting the configuration data and/or the configuration data integrity indicator using the configuration keying material. The configuration package data may be based on the encrypted configuration data and/or the encrypted configuration data integrity indicator. For example, the configuration package data may comprise the encrypted configuration data and/or the encrypted configuration data integrity indicator.

In one or more exemplary methods, the configuration package data may comprise a configuration payload block and a control block, and the configuration payload block may comprise the encrypted configuration data and the encrypted configuration data integrity indicator. The control block is for example metadata such as header, CDI, a length of the configuration data.

In one or more exemplary methods, generating the configuration package comprises encrypting the configuration package data, e.g. using the session key. In other words, the configuration package data including the encrypted configuration data and/or the encrypted configuration data integrity indicator, and/or the control block using the session key.

One or more exemplary methods comprise transmitting the configuration package to the server device. One or more exemplary methods may comprise deleting the session key and the configuration keying material after transmitting the configuration package In one or more exemplary methods, the method may comprise sending an access request to the server device and receiving an access response from the server device. For example the fitting device may send an access request based on a login and password, and receive an access response based on verification of the login and password. Sending an access request to the server device and receiving an access response from the server device may be performed to gain access to the server device for communicating (e.g. configuration initiation request and configuration package).

This disclosure relates to a method, performed at a server device of a hearing system, for remote configuration of a hearing device in the hearing system. The hearing system comprises the hearing device, a user application installed on an accessory device, a fitting device and the server device. The service device may comprise a secure module wherein the secure module is configured to perform security operations such as deriving keys, encrypting certificates, digitally signing. The secure module may be implemented as hardware security module, collocated or remotely located with the server device. The accessory device has the user application installed thereon.

The accessory device comprises a memory unit and an interface respectively connected to a processing unit. The memory unit has a user application stored thereon. The user application may be a hearing device application, e.g. configured to wirelessly communicate with the hearing device, such as to control and/or configure the hearing device. The interface comprises an antenna and a wireless transceiver, e.g. configured for wireless communication at frequencies in the range from 2.4 to 2.5 GHz. The interface may be configured for communication, such as wireless communication, with the hearing device comprising an antenna and a wireless transceiver. The accessory device forms an accessory device to the hearing device. The accessory device is typically paired or otherwise wirelessly coupled to the hearing device. The hearing device may be a hearing aid, e.g. of the behind-the-ear (BTE) type, in-the-ear (ITE) type, in-the-canal (ITC) type, receiver-in-canal (RIC) type or receiver-in-the-ear (RITE) type. Typically, the accessory device is in possession of and controlled by the hearing device user. The accessory device may be a handheld device, such as smartphone or a tablet computer, or a wearable device such as a smartwatch.

One or more exemplary methods performed at the server device comprise receiving a configuration initiation request from the fitting device. The configuration initiation request may comprise a hearing device identifier, and/or a session key. The session key may be received at the server device in encrypted form using a configuration initiation public key. The method may then comprise decrypting the session key using a corresponding configuration initiation private key. The configuration initiation request may comprise a session counter.

One or more exemplary methods performed at the server device comprise generating configuration keying material based on the session key. The configuration keying material may comprise a configuration key and/or a configuration counter, both of which may be in plaintext or in encrypted form using the session key. One or more exemplary methods performed at the server device comprise transmitting a configuration initiation response to the fitting device. The configuration initiation response comprises the configuration keying material.

One or more exemplary methods performed at the server device comprise generating configuration authentication material. In one or more exemplary methods performed at the server device, the method may comprise receiving an access request at the server device, and sending an access response to the fitting device. The access request may comprise a dispenser identifier. The dispenser identifier may be a unique identifier assigned to a dispenser operating a fitting device or a group of dispensers. The dispenser identifier is configured to support the server device in finding a dispenser certificate in the memory module of the server device or a database.

In one or more exemplary methods, generating the configuration authentication material comprises obtaining a certificate key based on the hearing device identifier; obtaining a dispenser certificate using the dispenser identifier; encrypting the dispenser certificate using the certificate key; and including the encrypted dispenser certificate in the configuration authentication material. For example, obtaining a certificate key based on the hearing device identifier may comprise retrieving a common secret from a memory module of the server device, or calculating the certificate key which is the output of a hash function that takes as input a string and the common secret. Obtaining a dispenser certificate using the dispenser identifier may comprise identifying or retrieving the dispenser certificate based on the dispenser identifier. The configuration authentication material may comprise type identifier that is used to identify the material as a configuration authentication material, a timestamp indicating when configuration authentication material is generated, a linking identifier configured to link the configuration authentication material to the configuration keying material, a hearing device identifier corresponding to the hearing device to which the configuration is addressed, an address identifier of the hearing device, a length of configuration authentication material, a challenge material, an index, a key identifier and/or the including the encrypted dispenser certificate.

One or more exemplary methods performed at the server device comprise transmitting a configuration initiation response to the fitting device, the configuration initiation response comprising the configuration keying material.

One or more exemplary methods performed at the server device comprise receiving a configuration package from the fitting device. The configuration package may comprise a configuration payload block and a control block (such as metadata, e.g. header and one or more checksum). The configuration payload block may comprise configuration data, and a configuration data integrity indicator. In one or more exemplary methods, receiving the configuration package from the fitting device may comprise decrypting the configuration package data using the session key.

One or more exemplary methods performed at the server device comprise calculating an integrity indicator set based on the configuration payload block and the control block. The integrity indicator set may comprise one or more integrity indicators, such a first integrity indicator, a second integrity indicator. For example, the method may comprise computing a first integrity indicator based on the configuration payload block and a second integrity indicator based on the control block. One or more exemplary methods performed at the server device comprise generating a configuration block based on at least a part of the integrity indicator set. The configuration block may comprise a block type identifier, a timestamp, a block identifier, a hearing device identifier of the hearing device, an address identifier, a first integrity indicator, and/or a second integrity indicator.

One or more exemplary methods performed at the server device comprise generating a configuration verification package based on the configuration block. In one or more exemplary methods, the method may comprise obtaining a first digital signature over the configuration block; and generating a configuration verification package is based on the first digital signature. For example, the server device may be configured to generate the first digital signature based on the configuration block and a configuration private key or to obtain the first digital signature from a secure module. Generating the configuration verification package based on the first digital signature may comprise including the first digital signature in the configuration verification package.

One or more exemplary methods performed at the server device comprise generating a configuration authentication package based on the configuration authentication material. In one or more exemplary methods, the method may comprise obtaining a second digital signature over the configuration authentication material; and generating a configuration authentication package is based on the second signature. For example, the server device may be configured to generate the second digital signature based on the configuration authentication material and a configuration private key or to obtain the second digital signature from a secure module. Generating the configuration authentication package based on the second digital signature may comprise including the second digital signature in the configuration authentication package. The configuration authentication package is generated so that the hearing device can verify the integrity of the configuration data.

One or more exemplary methods performed at the server device comprise transmitting the configuration package, the configuration verification package and the configuration authentication package, such as to the accessory device, to the application installed on the accessory device, or to the hearing device via the accessory device and possibly the application installed thereon.

The configuration verification package is used at the accessory device to verify the configuration package and/or the configuration authentication package. The configuration authentication package is used at the hearing device to authenticate the configuration package that actually comprises the fitting parameters or configuration data to be installed on the hearing device. In other words, the dispenser or the fitting device uses the server device to create a configuration authentication package for a specific hearing device. The configuration authentication package and the configuration package data in the configuration package are generated so that the hearing device is able to verify that the configuration package comes from a legitimate dispenser or legitimate fitting device and that the configuration data in the configuration package has not be tampered with nor disclosed by any other party because configuration data is private data that can be used to perform denial of service attack or battery exhaustion attacks on the hearing device.

This disclosure relates to a fitting device comprising a processing unit, a memory unit, and an interface. The fitting device is configured to perform any of the steps of the method according to this disclosure.

This disclosure relates to a server device comprising a processing unit, a memory unit, and an interface. The server device is configured to perform any of the steps of the method according to this disclosure.

The figures are schematic and simplified for clarity, and they merely show details which supports the present disclosure, while other details have been left out. Throughout, the same reference numerals are used for identical or corresponding parts.

FIG. 1 shows an exemplary hearing system 1. The hearing system 1 comprises a server device 4, a fitting device 2 and a hearing device system 6 comprising a hearing device 8 and an accessory device 10. The accessory device 10 is a handheld device such as smartphone configured to wirelessly communicate with the hearing device 8. A user application 12 is installed on the accessory device 10. The user application may be for controlling the hearing device 8 and/or assisting a hearing device user wearing/using the hearing device 8. In one or more exemplary user applications, the user application 12 is configured to transfer configuration data (e.g. hearing device settings or fitting parameters), to the hearing device. The accessory device 10 comprises a processing unit 36, a memory unit 38, and an interface 40.

The hearing device 8 comprises an antenna 24 and a radio transceiver 26 coupled to the antenna 24 for receiving/transmitting wireless communication including first communication link 20. The hearing device 8 comprises a set of microphones comprising a first microphone 28 and optionally a second microphone 30 for provision of respective first and second microphone input signals. The hearing device 8 may be a single-microphone hearing device. The hearing device 8 comprises a memory unit (not shown) connected to the processor 32, wherein configuration data, e.g. fitting or hearing device settings are stored in the memory unit.

The hearing device 8 comprises a processor 32 connected to the transceiver 26 and microphones 28, 30 for receiving and processing input signals. The processor 32 is configured to compensate for a hearing loss of a user based on hearing device settings and to provide an electrical output signal based on the input signals. A receiver 34 converts the electrical output signal to an audio output signal to be directed towards an eardrum of the hearing device user.

The fitting device 2 is capable of communicating with the server device 4 through communication link 22, and with the hearing device system 6 through communication link 23. The hearing device 8 is capable of communicating with the accessory device 10 through communication link 20. In an embodiment, the fitting device 2 is configured for communicating with the accessory device 10 via communication link 23 and the hearing aid device is configured for communication with the accessory device 10 via communication link 20.

In an embodiment, the server device 4 is configured to communicate with the hearing device system 6, such as with the accessory device 10, and/or optionally the hearing device 8, via communication link 21.

Figure 2:
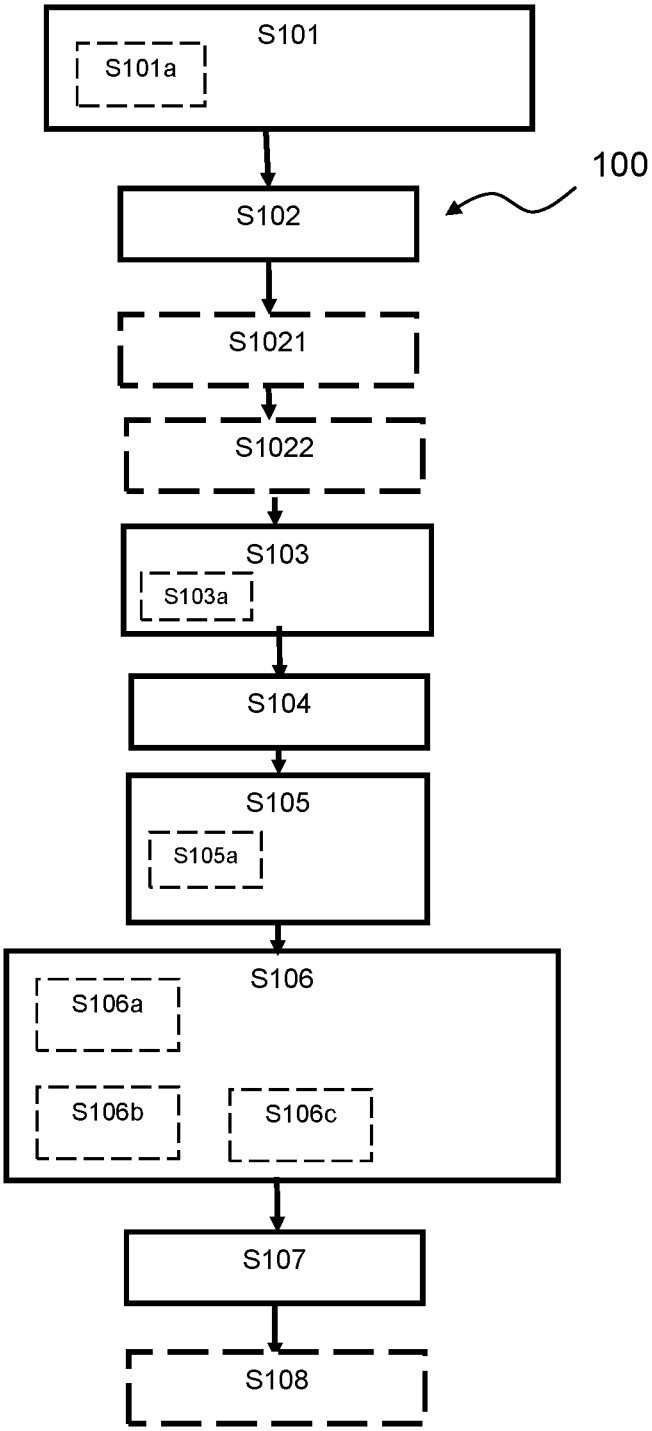
FIG. 2 is a flow diagram of an exemplary method performed at a fitting device according to this disclosure.

FIG. 2 shows a flow diagram of an exemplary method 100 performed at a fitting device (such as fitting device 2 of FIG. 1) according to this disclosure. FIG. 2 shows method 100 for remotely configuring a hearing device (such as hearing device 8 of FIG. 1) in the hearing system, the hearing system comprising the hearing device 8, the accessory device 10, the fitting device (such as fitting device 2 of FIG. 1) and a server device (such as server device 4 of FIG. 1). The method 100 comprises obtaining S101 hearing device data. The hearing device data comprises a hearing device identifier. In one or more exemplary methods, obtaining hearing device data comprises obtaining S101*a* or retrieving the hearing device data from a database remote from the fitting device such from the server device 4 via communication link 22. The method 100 comprises obtaining S102 a session key. Obtaining S102 a session key may comprise generating a session key e.g. as a random or pseudo-random number. The method 100 comprises generating S103 a configuration initiation request based on the session key and the hearing device identifier. For example, generating S103 the configuration initiation request may comprise encrypting S103*a* the session key using a configuration initiation public key, and including the encrypted session key in the configuration initiation request. The method 100 comprises transmitting S104 the configuration initiation request to the server device e.g. via communication link 22. The configuration initiation request comprise the session key, the hearing device identifier, optionally part of the hearing device data (e.g. the shared index), and optionally the session counter. The configuration initiation request is encrypted using the configuration initiation public key prior to transmission.

The method 100 comprises receiving S105 a configuration initiation response from the server device e.g. via communication link 22, the configuration initiation response comprising configuration keying material. Receiving S105 the configuration initiation response may comprise decrypting S105*a* the configuration keying material. For example, the configuration keying material is decrypted using the session key. The configuration keying material may comprise a configuration key (such as a symmetric key), and possibly a configuration keying counter.

The method 100 comprises generating S106 a configuration package based on configuration data for the hearing device and based on the configuration keying material. The configuration package comprises configuration package data. The configuration data may comprise data related to the hearing device. The data related to the hearing device may comprise hearing device settings and/or fitting parameters.

In one or more exemplary methods, generating S106 the configuration package comprises calculating S106*a* a configuration data integrity indicator based on the configuration data. The configuration package data may be based on the configuration data integrity indicator. In one or more exemplary methods, generating S106 the configuration package comprises encrypting S106*b* the configuration data and/or the configuration data integrity indicator using the configuration keying material. The configuration package data may be based on the encrypted configuration data and/or the encrypted configuration data integrity indicator. For example, the configuration package data may comprise the encrypted configuration data and/or the encrypted configuration data integrity indicator. In one or more exemplary methods, generating S106 the configuration package comprises encrypting S106*c* the configuration package data, e.g. using the session key.

The method 100 comprises transmitting S107 the configuration package to the server device e.g. via communication link 22. One or more exemplary methods 100 may comprise deleting S108 the session key and the configuration keying material after transmitting the configuration package.

In one or more exemplary methods, the method 100 may comprise sending S1021 an access request to the server device e.g. via communication link 22 and receiving S1022 an access response from the server device e.g. via communication link 22. For example the fitting device may send an access request based on a login and password, and receive an access response based on verification of the login and password. Sending an access request to the server device and receiving an access response from the server device may be performed to gain access to the server device for communicating (e.g. configuration initiation request and configuration package).

Figure 3:
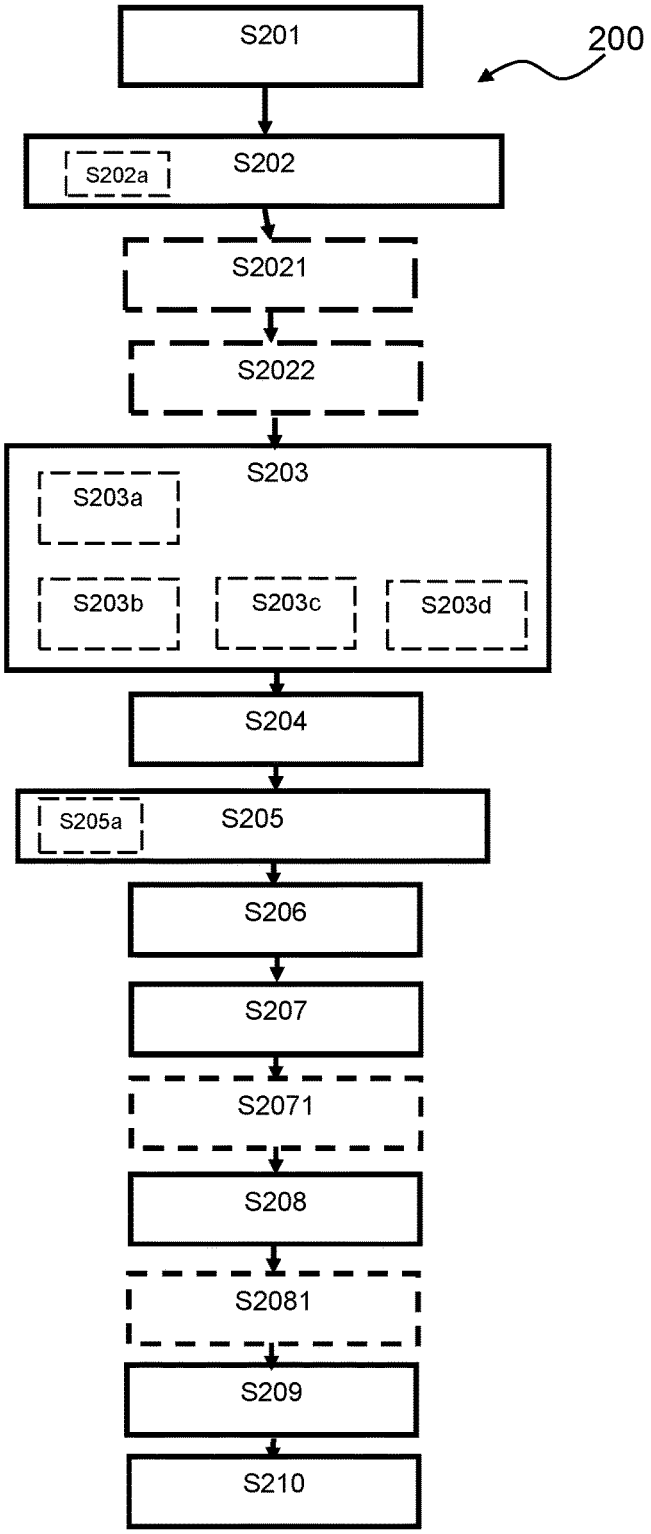
FIG. 3 is a flow diagram of an exemplary method performed at a server device according to this disclosure, FIG. 4 schematically illustrates an exemplary configuration package, and an exemplary configuration verification package according to this disclosure, FIG. 5 schematically illustrates an exemplary configuration authentication package according to this disclosure, FIG. 6 schematically illustrates an exemplary signaling diagram between a fitting device, a server device, an accessory device and a hearing device according to this disclosure, FIG. 7 schematically illustrates an exemplary fitting device according to this disclosure, and FIG. 8 schematically illustrates an exemplary server device according to this disclosure.

FIG. 3 shows a flow diagram of an exemplary method 200 performed at a server device (such as server device 4 of FIG. 1) according to this disclosure. FIG. 3 shows method 200 for remote configuration of a hearing device in the hearing system, such as for supporting the fitting device in performing a secure remote configuration of the hearing device. The hearing system comprises the hearing device, a user application installed on an accessory device, the fitting device and the server device.

Method 200 comprises receiving S201 a configuration initiation request from the fitting device e.g. via communication link 22. The configuration initiation request comprises a hearing device identifier, and/or a session key. The session key may be received at the server device in encrypted form using a configuration initiation public key. The method 200 may comprise decrypting the session key using a corresponding configuration initiation private key. The configuration initiation request may comprise a session counter.

Method 200 comprises generating S202 configuration keying material based on the session key. The configuration keying material may comprise a configuration key and/or a configuration counter, both of which may be in plaintext or in encrypted form using the session key. Method 200 comprises transmitting a configuration initiation response to the fitting device e.g. via communication link 22. The configuration initiation response comprises the configuration keying material.

Method 200 comprises generating S203 configuration authentication material. In one or more exemplary methods performed at the server device, method 200 may comprise receiving S2021 an access request at the server device, and sending S2022 an access response to the fitting device. The access request comprises a dispenser identifier. In one or more exemplary methods, method 200 comprises generating S203 the configuration authentication material comprises obtaining S203*a* a certificate key based on the hearing device identifier; obtaining S203*b* a dispenser certificate using the dispenser identifier; encrypting S203*c* the dispenser certificate using the certificate key; and including S203*d* the encrypted dispenser certificate in the configuration authentication material. For example, obtaining S203*a* a certificate key based on the hearing device identifier may comprise retrieving a common secret from a memory module of the server device, or calculating the certificate key which is the output of a hash function that takes as input a string and the common secret. Obtaining S203*b* a dispenser certificate using the dispenser identifier may comprise identifying or retrieving the dispenser certificate based on the dispenser identifier.

Method 200 comprises transmitting S204 a configuration initiation response to the fitting device e.g. via communication link 22, the configuration initiation response comprising the configuration keying material. Method 200 comprises receiving S205 a configuration package from the fitting device e.g. via communication link 22. The configuration package comprises a configuration payload block and a control block (such as metadata, e.g. header and one or more checksum). The configuration payload block may comprise configuration data, and a configuration data integrity indicator. In one or more exemplary methods, receiving S205 the configuration package from the fitting device may comprise decrypting S205*a* the configuration package data using the session key.

Method 200 comprises calculating S206 an integrity indicator set based on the configuration payload block and the control block. The integrity indicator set comprises one or more integrity indicators, each integrity indicator computed based one or more parts of the configuration package. For example, method 200 may comprise computing a first integrity indicator based on the configuration payload block and a second integrity indicator based on the control block. Method 200 comprises generating S207 a configuration block based on at least a part of the integrity indicator set. The configuration block may comprise the first integrity indicator, and/or the second integrity indicator, and optionally any of a block type identifier, a timestamp, a block identifier, a hearing device identifier of the hearing device, and an address identifier.

Method 200 comprises generating S208 a configuration verification package based on the configuration block. Method 200 may comprise obtaining S2071 a first digital signature over the configuration block and generating a configuration verification package is based on the first digital signature. For example, obtaining S2071 the first digital signature comprises generating the first digital signature based on the configuration block and a configuration private key or obtaining the first digital signature from a secure module. Generating S208 the configuration verification package may comprise including the first digital signature in the configuration verification package.

Method 200 comprises generating S209 a configuration authentication package based on the configuration authentication material. Method 200 may comprise obtaining S2081 a second digital signature over the configuration authentication material; and generating a configuration authentication package is based on the second signature. For example, obtaining S2081 the second digital signature comprises generating the second digital signature based on the configuration authentication material and a configuration private key or obtaining the second digital signature from a secure module. Generating the configuration authentication package based on the second digital signature may comprise including the second digital signature in the configuration authentication package.

Method 200 comprises transmitting S210 the configuration package, the configuration verification package and the configuration authentication package, such as to the accessory device, to the application installed on the accessory device, or to the hearing device via the accessory device and possibly the application installed thereon. For example, method 200 may comprise transmitting S210 the configuration package, the configuration verification package and the configuration authentication package to the accessory device 10, to the application installed 12 on the accessory device 10 via communication link 23. In one or more exemplary embodiments, method 200 may comprise transmitting S210 the configuration package, and the configuration authentication package through the accessory device 10 to the hearing device 8 via communication links 23 and 20.

Figure 4:
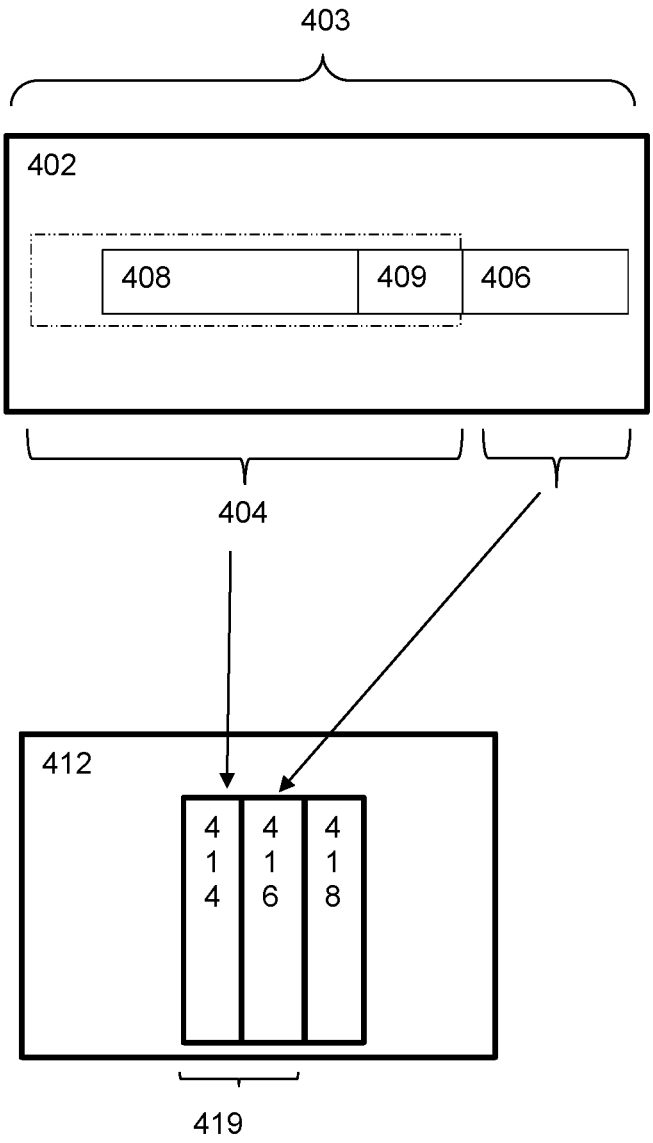

FIG. 4 schematically illustrates an exemplary configuration package 402, and an exemplary configuration verification package 412 according to this disclosure. The configuration package 402 comprising configuration package data 403. The configuration package data 403 comprises a configuration payload block 404 and a control block 406. The configuration package 402 is generated based on configuration data 408 for the hearing device. The configuration package data 403 comprises the configuration data 408, which is the actual fitting parameters or hearing device setting parameters, which are used to configure the hearing device. The configuration data 408 may be included in the configuration package data 403 in encrypted form using the configuration keying material comprising a configuration key. The configuration package data 403 comprises a configuration data integrity indicator 409 computed over the configuration data 408, and included in the configuration package data 403. The configuration payload block 404 comprises the configuration data 408 and the configuration data integrity indicator 409, which are optionally in encrypted form as indicated by the dashed box in FIG. 4. The control block 406 comprises headers, length of the configuration data and metadata. The fitting device may be configured to generate the configuration package by encrypting, e.g. using the session key, the configuration package data 403, i.e. the configuration payload block 404 and the control block 406. The configuration package is generated at the fitting device.

The configuration verification package 412 is generated at the server device. The configuration verification package 412 comprises a set of integrity indicators, such as a first integrity indicator 414, a second integrity indicator 416. The server receives a configuration package 402 from the fitting device. The configuration package 402 comprises a configuration payload block 404 and a control block 406. The server generates a configuration block 419 by computing a first integrity indicator 414 based on the configuration payload block 404 and a second integrity indicator 416 based on the control block 406, and including the first integrity indicator 414 and the second integrity indicator 416 into the configuration block 419. The server devices signs the configuration verification package 412 using a configuration private key. The configuration verification package 412 comprises a first digital signature 418.

Figure 5:
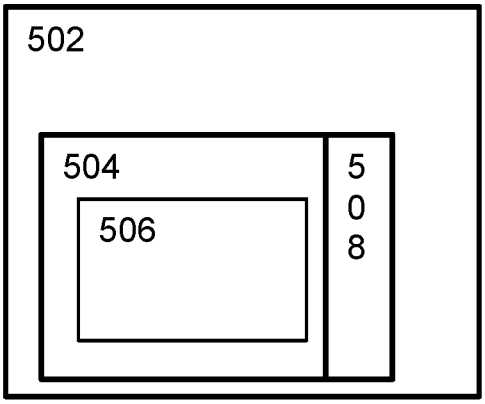

FIG. 5 schematically illustrates an exemplary configuration authentication package 502 according to this disclosure. The configuration authentication package 502 is generated by the server device. The configuration authentication package 502 comprises a configuration authentication material 504. The configuration authentication material 504 comprises a dispenser certificate 506, which may be encrypted using a certificate key, which comprised in the dispenser certificate retrieved by the server device using the dispenser identifier comprised in the access request received from the fitting device. The server obtains a second digital signature 508 over the configuration authentication material 504 using a configuration private key that is stored in the server device and used for configuration purposes. The configuration authentication package 502 comprises the second digital signature 508.

Figure 6:
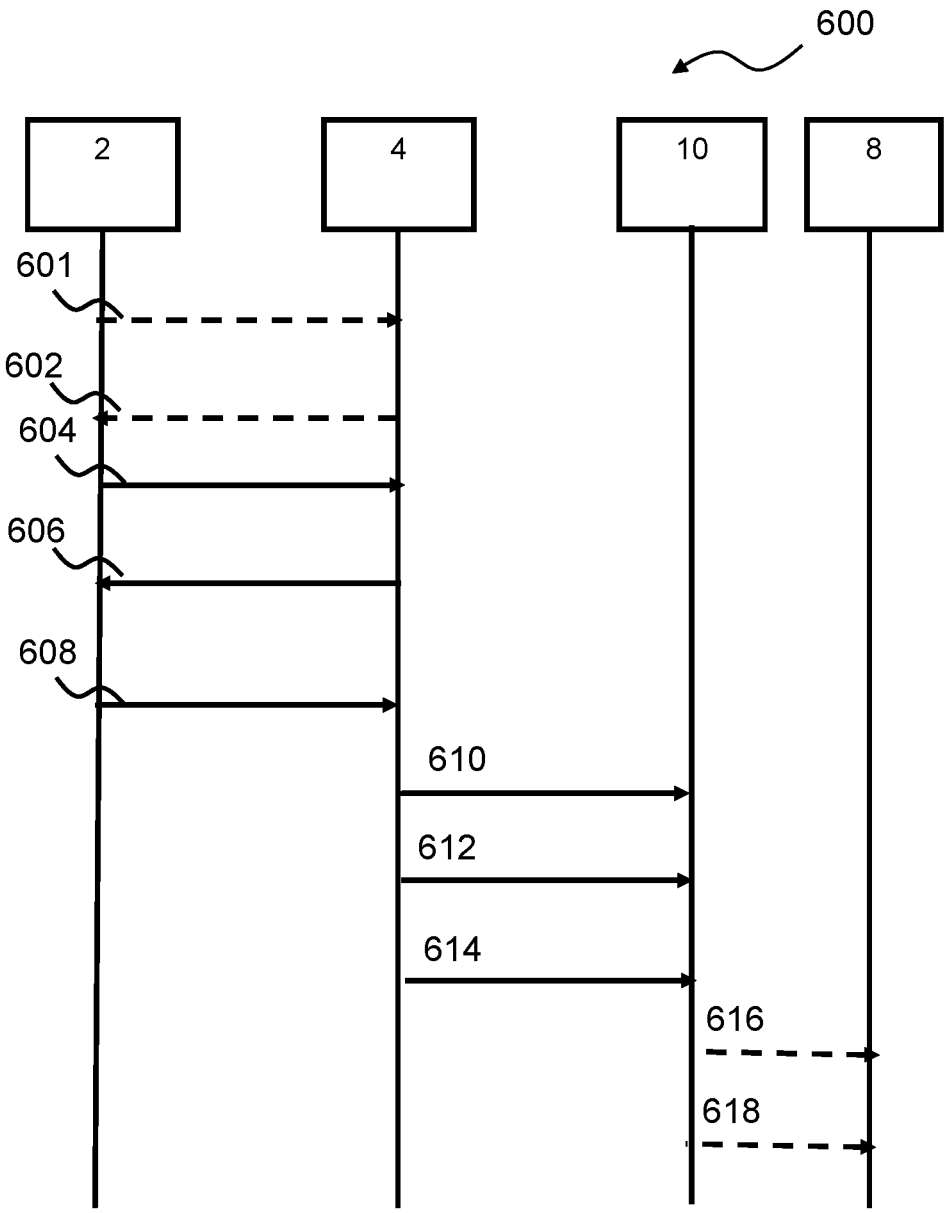

FIG. 6 schematically illustrates an exemplary signaling diagram 600 between a fitting device 2, a server device 4, an accessory device 10 and a hearing device 8 according to this disclosure. The fitting device 2 may be configured to send an access request 601 to the server device 4 and to receive an access response 602 from the server device. The access request may comprise a dispenser identifier that identifies the user of the fitting device 2. The fitting device 2 sends a configuration initiation request 604 to the server device 4. The configuration initiation request 604 comprises the session key, the hearing device identifier, optionally part of the hearing device data (e.g. the shared index), and optionally the session counter. The server device 4 responds with a configuration initiation response 606, the configuration initiation response 606 comprising configuration keying material. The fitting device 2 generates a configuration package based the configuration keying material received and configuration data that the dispenser has devised on the fitting device 2. The fitting device 2 transmits the configuration package 608 to the server device 4.

The server device 4 generates a configuration verification package 610 as disclosed in steps SS206, S207, S2071, and S208. The server device 4 sends the configuration verification package 610 to the accessory device 10 or the user application installed thereon via communication link 21, or optionally via the fitting device 2 and communication links 22 and 23. The server device 4 generates a configuration authentication package 612 as disclosed in steps S203, S203*a-c*, S2081, and S209. The server device 4 sends a configuration authentication package 612 to the accessory device 10 or the user application installed thereon. The server device 4 decrypts the configuration package 608 received from the fitting device 2 using the session key shared between the server device 4 and the fitting device 2. The server device sends the resulting configuration package in message 614 to the accessory device 10 or the user application installed thereon. The accessory device 10 may then pass on to the hearing device the configuration authentication package in a message 616 and the configuration package in a message 618 so that the secure remote configuration can take place.

Figure 7:
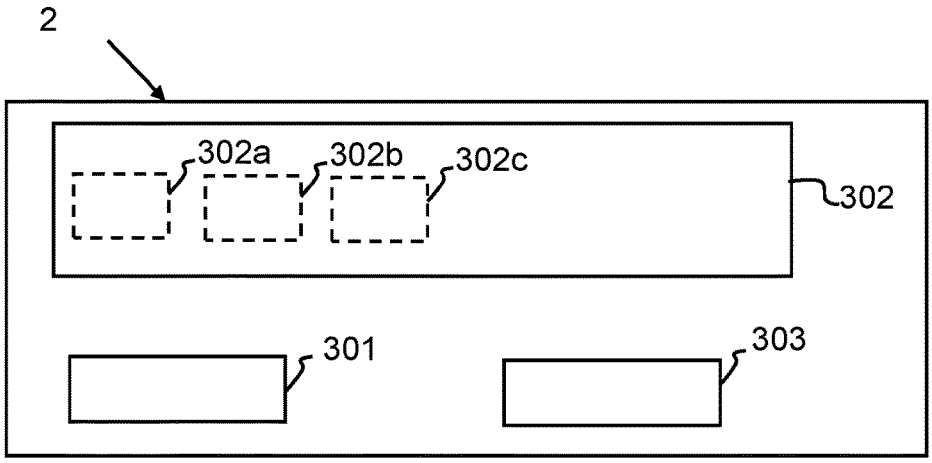

FIG. 7 schematically illustrates an exemplary fitting device 2 according to this disclosure. The fitting device 2 comprising a processing unit 302, a memory unit 301, and an interface 303. The fitting device 2 or the processing unit 302 is configured to perform any of the steps of the method according to this disclosure (such as method 100 of FIG. 2). The processing unit 302 is configured to obtain hearing device data. The processing unit 302 is configured to generate a session key e.g. as a random or pseudo-random number. The processing unit 302 is configured to generate a configuration initiation request based on the session key and the hearing device identifier. The interface 303 is configured to transmit the configuration initiation request to the server device. The configuration initiation request comprise the session key, the hearing device identifier, optionally part of the hearing device data (e.g. the shared index), and optionally the session counter. The configuration initiation request is encrypted by the processing unit 302 using the configuration initiation public key prior to transmission.

The interface 303 is configured to receive a configuration initiation response from the server device, the configuration initiation response comprising configuration keying material. The processing unit 302 is configured to decrypt the configuration keying material, e.g. using the session key. The configuration keying material may comprise a configuration key (such as a symmetric), and possibly a configuration keying counter.

The processing unit 302 is configured to generate a configuration package based on configuration data for the hearing device and based on the configuration keying material. The configuration package comprises configuration package data. The configuration data may comprise data related to the hearing device. The data related to the hearing device may comprise hearing device settings and/or fitting parameters.

The processing unit 302 may be configured to generate the configuration package by calculating a configuration data integrity indicator based on the configuration data. The processing unit 302 is configured to generate the configuration package by encrypting the configuration data and/or the configuration data integrity indicator using the configuration keying material. The configuration package data may be based on the encrypted configuration data and/or the encrypted configuration data integrity indicator. For example, the configuration package data may comprise the encrypted configuration data and/or the encrypted configuration data integrity indicator. The processing unit 302 may be configured to generate the configuration package by encrypting the configuration package data, e.g. using the session key.

The interface 303 is configured to transmit the configuration package to the server device. The processing unit 302 may be configured to delete the session key and the configuration keying material after transmitting the configuration package The interface 303 is configured to send an access request to the server device and receive an access response from the server device.

The interface 303 may be configured to communicate with a user of the fitting device (e.g. a dispenser) using e.g. a keyboard and/or a display.

The fitting device 2 or the processing unit 302 is arranged to execute methods for remote configuration of a hearing device as disclosed herein. The fitting device 2 or the processing unit 302 may further comprise a number of optional functional modules, such as any of an obtain module 302*a* configured to perform steps S101 and S102, and a generate module 302*b* configured to perform step S103 and S106. The obtain module 302*a* is optionally configured to perform step S101*a*. The generate module 302*b* is optionally configured to perform step S103*a*. The generate module 302*b* is optionally configured to perform steps S106*a*, S106*b*, S106*c*. The processing unit 302 may further comprise a delete module 302*c* configured to perform step S108. The functionality of each functional module 302*a-c* is disclosed in the context of which the functional modules 302*a-c* may be used in FIG. 2 and accompanying text. In general terms, each functional module 302*a-c* may be implemented in hardware or in software. Preferably, one or more or all functional modules 302*a-c* may be implemented by the processing module 302, possibly in cooperation with functional units 301 and 303. The processing module 302 may thus be arranged to fetch instructions from the memory module 301 as provided by a functional module 302*a-c* and to execute these instructions, thereby performing any steps of method 100 as disclosed herein in FIG. 2.

Figure 8:
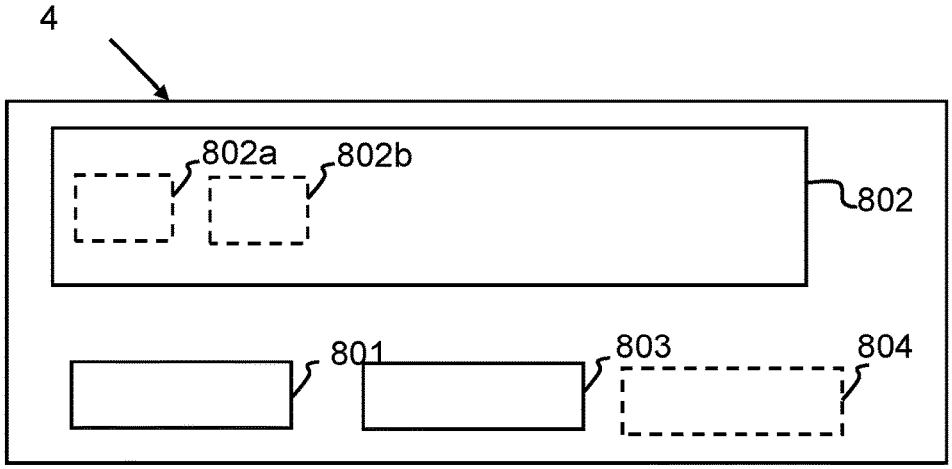

FIG. 8 schematically illustrates an exemplary server device 4 according to this disclosure. The server device 4 comprises a processing unit 802, a memory unit 801, and an interface 803. The memory unit 801 may include removable and non-removable data storage units including, but not limited to, Read Only Memory (ROM), Random Access Memory (RAM), etc. The server device 4 is configured to perform any of the steps of the method according to this disclosure (such as method 200 of FIG. 3).

The server device 4 or the interface 803 is configured to receive a configuration initiation request from the fitting device, the configuration initiation request comprising a hearing device identifier, and a session key.

The server device 4 or the processing unit 802 is configured to generate configuration keying material based on the session key. The server device 4 or the processing unit 802 is configured to generate configuration authentication material. The server device 4 or the interface 803 is configured to transmit a configuration initiation response to the fitting device, the configuration initiation response comprising the configuration keying material. The server device 4 or the interface 803 is configured to receive a configuration package from the fitting device, the configuration package comprising a configuration payload block and a control block. The server device 4 or the processing unit 802 is configured to calculate an integrity indicator set based on the configuration payload block and the control block. The server device 4 or the processing unit 802 is configured to generate a configuration block based on at least a part of the integrity indicator set. The server device 4 or the processing unit 802 may be configured to obtain a first digital signature over the configuration block. The server device 4 or the processing unit 802 is configured to generate a configuration verification package based on the configuration block and optionally the first digital signature. The server device 4 or the processing unit 802 may be configured to obtain a second digital signature over the configuration authentication material. The server device 4 or the processing unit 802 is configured to generate a configuration authentication package based on the configuration authentication material, and optionally on the second signature. The server device 4 or the interface 803 is configured to transmit the configuration package, the configuration verification package and the configuration authentication package, to e.g. the hearing device and/or the accessory device.

The server device 4 may comprise a secure module 804 to perform cryptographic functions, such as encrypting, decrypting and digitally signing. The secure module 804 may be implemented as hardware security module, collocated or remotely located with the server device 4.

The server device 4 or the processing unit 802 is arranged to execute methods for supporting the remote configuration of the hearing device as disclosed herein. The server device 4 or the processing unit 802 may further comprise a number of optional functional modules, such as any of a generate module 802*a* configured to perform step S202, S203, S207, S208, and S209. The generate module 802*a* is optionally configured to perform step S203*a-d*. The generate module 802*a* is optionally configured to perform step S202*a*. The processing unit 802 may further comprise an obtain module 802*b* configured to perform step S2071 and optionally S2081. The functionality of each functional module 802*a-b* is disclosed in the context of which the functional modules 802*a-b* may be used in FIG. 3 and accompanying text. In general terms, each functional module 802*a-b* may be implemented in hardware or in software. Preferably, one or more or all functional modules 802*a-b* may be implemented by the processing module 802, possibly in cooperation with functional units 801 and 803, and optionally 804. The processing module 802 may thus be arranged to fetch instructions from the memory module 801 as provided by a functional module 802*a-b* and to execute these instructions, thereby performing any steps of method 200 as disclosed herein in FIG. 3.

The interface 803 may be configured to communicate with a user of the server device using e.g. a keyboard and/or a display.

The use of the terms "first", "second", "third" and "fourth", etc. does not imply any particular order, but are included to identify individual elements. Moreover, the use of the terms first, second, etc. does not denote any order or importance, but rather the terms first, second, etc. are used to distinguish one element from another. Note that the words first and second are used here and elsewhere for labelling purposes only and are not intended to denote any specific spatial or temporal ordering. Furthermore, the labelling of a first element does not imply the presence of a second element and vice versa.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

1 hearing system
2 fitting device
4 server device
6 hearing device system
8 hearing device
10 accessory device
12 user application
20 communication link between user accessory device and hearing device
21 communication link between server device and user accessory device
22 communication link between fitting device and server device
23 communication link between fitting device and hearing device system
24 antenna
26 radio transceiver
28 first microphone
30 second microphone
32 processor
32*a* determine module
32*b* update module

33 interface
34 receiver
35 memory unit
36 processing unit
36*a* determine module
38 memory unit
40 interface
100 method performed at the fitting device
200 method performed at the server device
301 memory unit
302 processing unit
302*a* obtain module
302*b* generate module
302*c* delete module
303 interface
402 configuration package
403 configuration package data
404 configuration payload block
406 configuration control block
408 configuration data
409 configuration data integrity indicator
412 configuration verification package
414 first integrity indicator
416 second integrity indicator
418 first digital signature
419 configuration block
502 configuration authentication package
504 configuration authentication material
506 dispenser certificate
508 second digital signature
600 signaling diagram
601 access request
602 access response
604 configuration initiation request
606 configuration initiation response
608 configuration package
610 configuration verification package
612 configuration authentication package
614 message
616 message
618 message
801 memory unit
802 processing unit
802*a* generate module
802*b* obtain module
803 interface
804 secure module

The invention claimed is:

1. A method performed by a fitting device, the fitting device being a part of a hearing system configured for remotely configuring a hearing device, the method comprising:

obtaining hearing device data comprising a hearing device identifier of the hearing device;

obtaining a session key;

generating a configuration initiation request based on the session key and the hearing device identifier;

transmitting the configuration initiation request to a server device;

receiving a configuration initiation response from the server device, the configuration initiation response comprising configuration keying material;

generating a configuration package based on configuration data for the hearing device and based on the configuration keying material, the configuration package comprising configuration package data; and transmitting the configuration package to the server device;

wherein the method further comprises obtaining a configuration data integrity indicator based on the configuration data;

wherein the act of generating the configuration package comprises encrypting the configuration data and/or the configuration data integrity indicator, and wherein the configuration package data is based on the encrypted configuration data and/or the encrypted configuration data integrity indicator; and wherein the configuration package data comprises a configuration payload block and a control block, and wherein the configuration payload block comprises the encrypted configuration data and/or the encrypted configuration data integrity indicator.

2. The method according to claim 1, wherein the act of generating the configuration initiation request comprises encrypting the session key using a configuration initiation public key, and including the encrypted session key in the configuration initiation request.

3. The method according to claim 1, wherein the hearing device data comprises a shared index, a fitting device key identifier, an address identifier, fitting information, or any combination of the foregoing.

4. The method according to claim 1, wherein the configuration keying material is encrypted, and wherein the method further comprises decrypting the configuration keying material.

5. The method according to claim 1, wherein the act of generating the configuration package comprises encrypting the configuration package data.

6. The method according to claim 1, further comprising:

sending an access request to the server device; and receiving an access response from the server device.

7. The method according to claim 1, further comprising deleting the session key and the configuration keying material after the configuration package is transmitted.

8. A method, performed by a server device, the server device being a part of a hearing system configured for remotely configuring a hearing device, the method comprising:

receiving a configuration initiation request from a fitting device, the configuration initiation request comprising a hearing device identifier, and a session key;

generating configuration keying material based on the session key;

generating configuration authentication material;

transmitting a configuration initiation response to the fitting device, the configuration initiation response comprising the configuration keying material;

receiving a configuration package from the fitting device, the configuration package comprising a configuration payload block and a control block;

calculating an integrity indicator set based on the configuration payload block and the control block;

generating a configuration block based on at least a part of the integrity indicator set;

generating a configuration verification package based on the configuration block;

generating a configuration authentication package based on the configuration authentication material; and transmitting the configuration package, the configuration verification package, and the configuration authentication package.

9. The method according to claim 8, wherein the act of generating the configuration keying material based on the session key comprises encrypting a configuration session key using the session key, and including the encrypted configuration session key into the configuration keying material.

10. The method according to claim 8, further comprising:

receiving an access request at the server device, the access request comprising a dispenser identifier; and sending an access response to the fitting device.

11. The method according to claim 8, further comprising:

obtaining a first digital signature associated with the configuration block;

wherein the configuration verification package is generated based on the first digital signature.

12. The method according to claim 11, further comprising:

obtaining a second digital signature associated with the configuration authentication material;

wherein the configuration authentication package is generated based on the second signature.

13. The method according to claim 8, wherein the act of generating the configuration authentication material comprises:

obtaining a certificate key based on the hearing device identifier;

obtaining a dispenser certificate using the dispenser identifier;

encrypting the dispenser certificate using the certificate key; and including the encrypted dispenser certificate in the configuration authentication material.

14. The method according to claim 8, wherein the configuration package comprises encrypted configuration package data, and wherein the method further comprises decrypting the encrypted configuration package data using the session key.

15. A fitting device configured to perform the method of claim 1.

16. A server device configured to perform the method of claim 8.

* * * * *